United States Patent [19]

Haywood

[11] 4,167,141

[45] Sep. 11, 1979

[54] PERCUSSIVE TOOL WITH REPLACEABLE WORK BIT

[76] Inventor: Glen H. Haywood, 4207 Cedarwood, Matteson, Ill. 60443

[21] Appl. No.: 795,718

[22] Filed: May 11, 1977

[51] Int. Cl.[2] ..... E01B 27/00

[52] U.S. Cl. ..... 104/10; 37/142 R; 83/831

[58] Field of Search ..... 172/719; 37/141 R, 141 T, 37/142 R, 142 A; 175/410; 294/56; 173/126, 132; 83/831; 104/10, 11, 12, 13, 14; 29/252, 239

[56] References Cited

U.S. PATENT DOCUMENTS

| | | | |
|---|---|---|---|
| 2,010,057 | 8/1935 | Buckwalter | 29/252 |
| 2,439,692 | 4/1948 | McKay | 29/252 |
| 2,463,124 | 3/1949 | Sims | 37/142 R |
| 2,671,262 | 3/1954 | Kuniholm | 29/252 |
| 3,259,035 | 7/1966 | Pfundt | 94/49 |
| 3,267,568 | 8/1966 | Johnson et al. | 29/252 |
| 3,581,664 | 1/1971 | Kruse et al. | 104/10 |
| 3,655,244 | 4/1972 | Swisher | 37/142 R |
| 3,729,055 | 4/1973 | Burridge | 104/10 |
| 3,826,025 | 7/1974 | Elliott | 37/142 R |
| 3,901,159 | 8/1975 | Von Beckmann | 104/12 |

FOREIGN PATENT DOCUMENTS

| | | | |
|---|---|---|---|
| 2138701 | 3/1971 | Fed. Rep. of Germany | 29/252 |
| 870106 | 3/1942 | France | 255/64 |

*Primary Examiner*—Douglas C. Butler
*Attorney, Agent, or Firm*—Haight, Hofeldt, Davis & Jambor

[57] ABSTRACT

A percussive tool, such as a tamping tool used with railroad bed tamping apparatus, has a replaceable work bit, such as a tamping foot. The removable tamping foot is secured to a shank by a tapered force fit. A repulsive force is generated between the shank and the tamping foot when it is desired to remove the tamping foot from the shank. Production of the repulsive force is achieved by pumping a fluid into an expandable chamber between the shank and the tamping foot. Preferably, a hand-operated grease gun drives grease into the expandable chamber to produce the repulsive force.

11 Claims, 15 Drawing Figures

PERCUSSIVE TOOL WITH REPLACEABLE WORK BIT

BACKGROUND OF THE INVENTION

1. Field of the Invention

This invention relates generally to percussive tools having a removable work bit, and more specifically, this invention relates to a tamping tool for railroad bed tamping apparatus having an easily removable and replaceable tamping foot.

2. Description of the Prior Art

Percussion tools have a work bit or work area that bears the brunt of the percussive impact. Accordingly, it is desirable to have this work bit formed of a material that is as hard as possible, as the impact forces tend to cause the work bit to become worn and to fail in a relatively short time. Also, in some percussive tools it is desirable to be able to achieve different functions, which requires different work bits. Therefore, it is desirable to be able to change the work bits to provide these different functions, as well as to replace work bits as they become worn out.

Tamping tools for use with railroad bed tamping equipment illustrate a particular type of percussive tool in which these problems are encountered. Gross movements and primary tamping action of the tamping tools is achieved by a suitable drive mechanism, such as a pneumatic or hydraulic system. In addition, the tamping tools are given a vibratory motion at a relatively high frequency, usually by means of an electrical drive arrangement.

In the most common form of prior art tamping tool, the shank and tamping foot of the tool are unitarily formed. As it is desirable to have a relatively soft workable material for the shank, while the tamping foot should be as hard as possible to resist wear produced by the tamping action, a compromise is necessary. Accordingly, the tamping foot is generally of a softer metal than preferable, which means that the tamping tool has to be replaced relatively frequently. As the shank and tamping foot are integrally formed, this means that the entire tamping tool must be replaced. This is, of course, a relatively expensive proposition, and the handling of the relatively large tamping tool creates additional problems. Accordingly, it would be most desirable if a tamping foot formed of a hard material could be selectively removed for replacement by a new tamping foot, upon the original tamping foot becoming worn. In addition, such a removable tamping foot would permit the substitution of different foot configurations upon encountering different ballast materials or conditions, as well as the substitution of other types of tools or work bits.

Various attempts have been made to provide removable tamping feet. The most common approach of this sort is the utilization of threaded bolts or screws, or transversely extending pins. One of the difficulties with these approaches is that it is necessary for the operator to carry appropriate tools to effect the change in a tamping foot. Another very significant difficulty is that the ballast with which the tamping foot is being utilized tends to work around the bolts or pins to produce a sealing action, which greatly hampers removal of the tamping foot.

Another approach has been to affix the tamping foot by a force fit, sometimes with the addition of an adhesive. Removal of the tamping foot is then achieved by striking the foot with a suitable instrument. As the tamping foot must be driven on the shank with considerable force in order to prevent its becoming unattached during tamping, the force of the blows to achieve desired separation must be relatively large. Thus, not only is considerable effort required to remove the tamping foot, but there is also considerable risk of damaging the relatively soft shank.

SUMMARY OF THE INVENTION

The present invention provides a removable work bit, such as the tamping foot of a tamping tool, which obviates the problems of the prior art approaches. With the structure of the present invention, the tamping foot may be easily removed for replacement by a new or different tamping foot, or by another type of tool head. Thus, a worn out tamping foot may be replaced, different types of tamping feet may be utilized for differing ballast conditions, and other types of tool heads, such as a pronged fork for loosening the ballast, may be substituted.

Applicant achieves these results by providing a replaceable work bit or tamping foot having a socket formed therein to receive a socket engaging portion at the lower end of the shank. A suitable force fit, in the nature of an interference fit, between the tamping foot and shank may be achieved by the utilization of proper tapers on the socket of the foot and the socket engaging portion of the shank. In order to assist in preventing relative rotation between the tamping foot and the shank, mating flat surfaces may be formed in the socket and on the socket engaging portion of the shank.

In order to effect simple removal of the tamping foot from the shank, a removal arrangement generates an internal repulsive force between the tamping foot and the shank. This may be achieved by the provision of an expandable chamber between the foot and shank, such as by appropriate design of the tapers of the socket and the socket engaging portion to prevent the end of the shank from coming into contact with the bottom of the socket. In addition, a conical projection of the socket may be utilized to insure that the expandable chamber will not be eliminated by bottoming of the shank end in the socket. A passageway may then be extended through the shank to an appropriate fitting above the tamping foot, at which point a suitable pumping apparatus may be attached to drive a fluid through the passageway into the expandable chamber to break the fluid-tight joint between the tamping foot and the shank to permit hand removal of the foot. A preferred pumping apparatus is a hand-operated grease gun of the type routinely provided with a tamping apparatus for daily maintenance. This grease gun can easily generate the required repulsive force between the tamping foot and shank to overcome the fluid-tight joint produced by the forcible wedging of the tamping foot onto the shank, without the use of any other tools.

In order to increase the binding force of the force fit between the tamping foot and the shank, it is desirable to slightly distort the socket, so that as the foot is driven on the shank an increased clamping action is achieved. One way to achieve this is to form a pair of vertical weld beads on the outer surface of the foot, the weld beads being displaced from one another by 180°. The slight shrinkage that accompanies any welding action gives a slightly elliptical curvature to the socket, to thus increase the clamping action when the foot is placed on the shank.

In some cases, it may be desirable to affix the foot to the shank even more securely than provided by the clamping action of the force fit produced by wedging the foot on the shank. When so desired, a locking arrangement, such as a socket head set screw with a slotted keyway, or a threaded taper pin, may be utilized.

In this fashion, applicant has provided a removable tamping foot that may be easily and quickly secured on the shank. At the same time, the very strong binding or clamping forces achieved by wedging the foot on the shank may be easily overcome by utilization of a hand-operated grease gun, routinely available to the operator.

These and other objects, advantages and features of this invention will hereinafter appear, and for purposes of illustration, but not of limitation, exemplary embodiments of the subject invention are shown in the appended drawing.

DETAILED DESCRIPTION OF THE PREFERRED EMBODIMENTS

Figure 1:
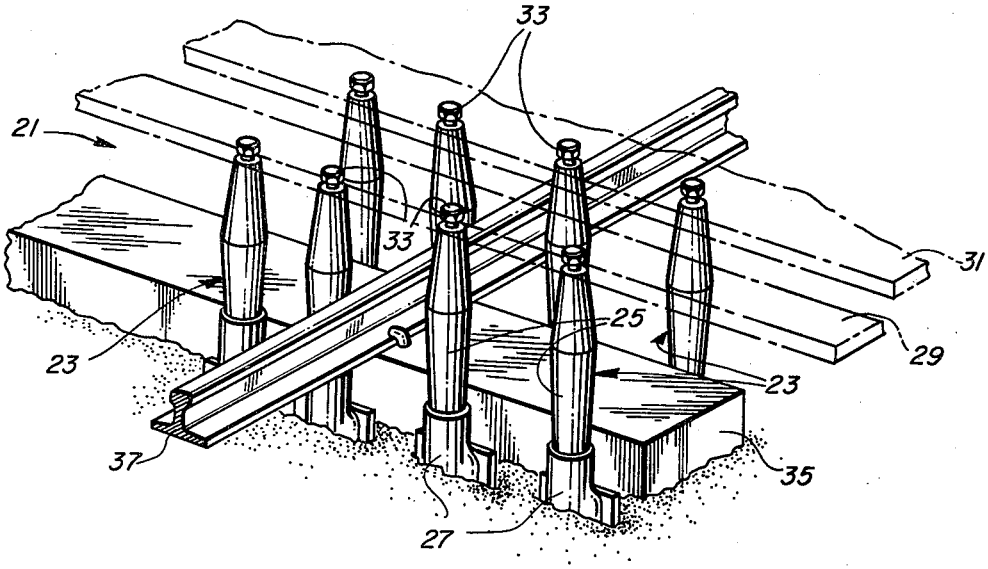
FIG. 1 is a perspective view of a portion of a tamping apparatus, utilized in tamping ballast on a railroad bed, employing tamping tools constructed in accordance with the present invention.

In FIG. 1 there is illustrated a schematic representation of a portion of a tamping apparatus 21 utilized in railroad bed tamping operations. Eight tamping tools 23 are illustrated. Each of the tamping tools 23 has a shank 25 and a tamping foot 27. Shanks 25 are of a generalized form for illustrating the present invention, with the preferred structure of such shanks being illustrated in FIGS. 13–15.

Figure 2:
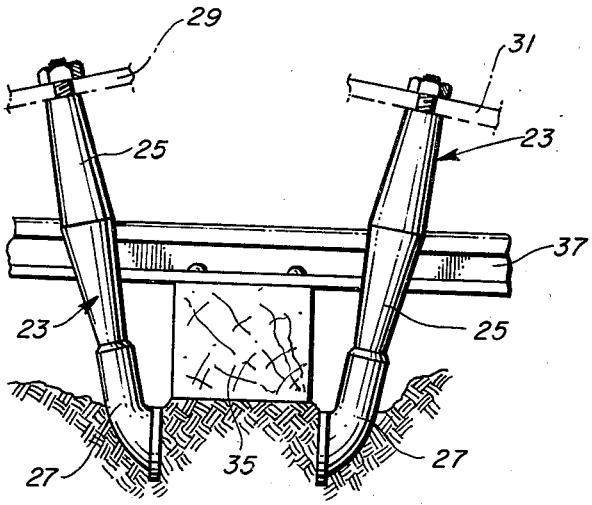
FIG. 2 is a side elevational view of two tamping tools illustrating the operation of the apparatus of FIG. 1.

Tamping tools 23 are affixed to supports 29 and 31 by any appropriate type of connector 33, shown here as a threaded connection with a nut. Supports 29 and 31 are driven by a suitable actuating mechanism, such as a pneumatic or hydraulic arrangement. This hydraulic or pneumatic drive provides the gross up and down movements for the tamping tools 23, as well as the primary compression force as the ballast is compacted under a tie 35. In addition, another driving apparatus, usually electrically energized, causes the tamping foot to be vibrated at a relatively high frequency (normally in the range of from 1250 to 4500 Hertz). This oscillatory motion aids in compacting the ballast under the tie. The clamping or compacting action of the tamping tool 23 is best illustrated in FIG. 2.

The eight tamping tools illustrated in FIG. 1 are uniformly spaced on either side of a tie 35 and uniformly distributed on each side of a rail 37. A similar group of eight tamping tools would normally be utilized about the adjacent rail.

Figure 3:
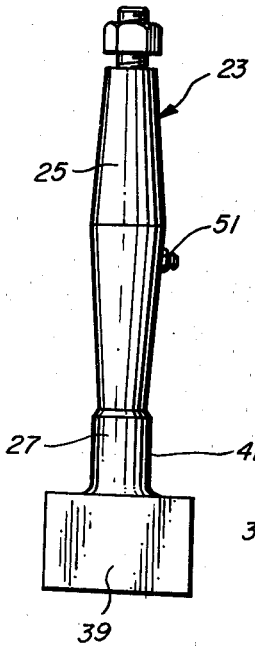
FIG. 3 is a generalized front elevational view of a tamping tool constructed in accordance with the present invention.
Figure 4:
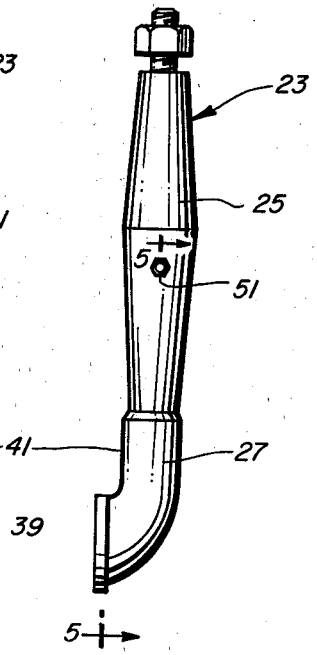
FIG. 4 is a side elevational view of the tamping tool of FIG. 3.
Figure 5:
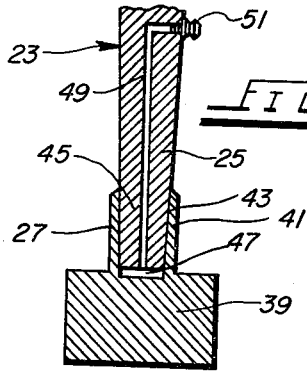
FIG. 5 is a partial cross-sectional view taken along line 5—5 of FIG. 4.
Figure 6:
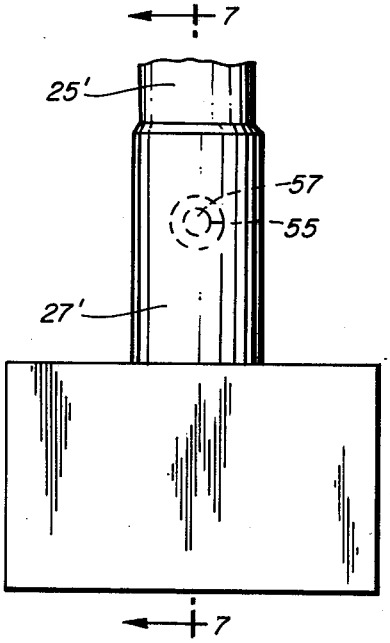
FIG. 6 is a partial front elevational view of a second embodiment of a tool constructed in accordance with the present invention.
Figure 7:
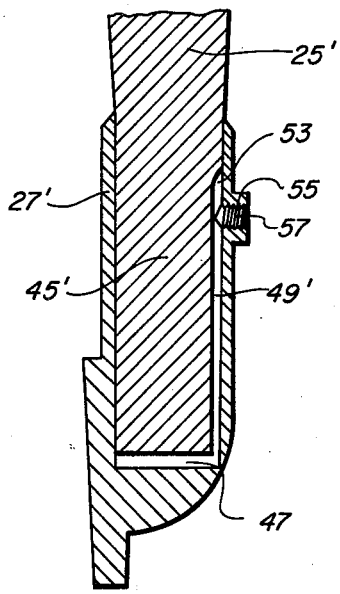
FIG. 7 is a cross-sectional view taken along line 7—7 of FIG. 6.

With reference now to FIGS. 3–5, a tamping tool 23 having a generalized shank 25 is illustrated for purposes of exemplifying the invention. As may be seen, the tamping foot 27 has a flat tamping surface 39 and an extending sleeve 41. A socket 43 is located in sleeve 41 and adapted to receive a socket engaging portion 45 of shank 25, with sleeve 41 extending upwardly sufficiently to protect the normally exposed part of the shank from abrasive wear during tamping action.

While any suitable arrangement for wedging the socket engaging portion 45 of shank 25 into the socket 43 to secure foot 27 to shank 25 may be employed, the preferred approach of this invention is to provide a slight taper for both the socket 42 and portion 45. The angles of the tapers of socket 43 and socket engaging portion 45 are such that when socket 43 is forcibly wedged over portion 45 a fluid-tight joint is formed between foot 27 and shank 25. When securing foot 27 to shank 25, portion 45 will normally be forced into socket 43 to the greatest extent possible by hand pressure. Foot 27 may then be seated on the shank 25 by causing the pneumatic or hydraulic drive to vertically reciprocate tool 23. By placing a suitable material, such as a piece of a broken tie or other body wood, under the tamping foot, the tamping foot 27 will be securely forced onto shank 25. Of course, during operation of the tamping tool, impact with the ballast material of the railroad bed will further strengthen the engagement between the shank 25 and tamping foot 27.

Another aspect of the tapers of socket 43 and socket receiving portion 45 is that the angles of the tapers should be such that the end of the portion 45 should never be permitted to come into contact with the bottom of the socket 43. In this fashion, an expandable chamber 47 is formed which may be utilized to aid in separating tamping foot 27 from shank 25, when so desired. Of course, other approaches may be utilized to provide opposing surfaces on shank 25 and foot 27, or other means may be utilized to provide internal repulsive forces between the shank and the tamping foot. However, in this preferred embodiment repulsive forces between shank 25 and foot 27 are generated by forcing a fluid into expandable chamber 47.

Fluid is inserted into the expandable chamber 47 through a passageway 49 formed in shank 25. An appropriate fitting 51 is located on the shank 25 above the end of sleeve 41 of foot 27. A suitable pumping apparatus may be connected to the fitting 51 to force the fluid into expandable chamber 47 through passageway 49.

While any appropriate fluid may be utilized to generate the repulsive forces between the shank 25 and foot 27, especially appropriate hydraulic arrangements, fitting 51 is a fitting to which a grease gun may be attached for forcing grease through passageway 49 to expandable chamber 47. As a hand-operated grease gun is routinely provided for daily maintenance of the tamping apparatus, no additional tools are required. Thus, by merely utilizing the normally present hand-operated grease gun, the operator may easily generate sufficient repulsive force to break the fluid-tight joint between shank 25 and foot 27 to permit removal of the tamping foot 27 by hand.

In some cases, it is possible that an additional locking action besides the binding force produced by wedging the foot on the shank may be required. In FIGS. 6–9, two such additional locking arrangements are illustrated. The embodiment of FIG. 6 employs a slotted keyway 53 formed in the socket receiving portion 45' of shank 25'. Slotted keyway 53 extends into passageway 49' that is now located at the periphery of portion 45', rather than centrally located as in the embodiment of FIG. 5. A threaded opening 55 formed in the tamping foot 27' receives a socket head set screw to lock foot 27' to shank 25'. When it is desired to remove the foot 27', fitting 51 replaces set screw 57 to permit the forcible insertion of grease or other fluid.

Figure 8:
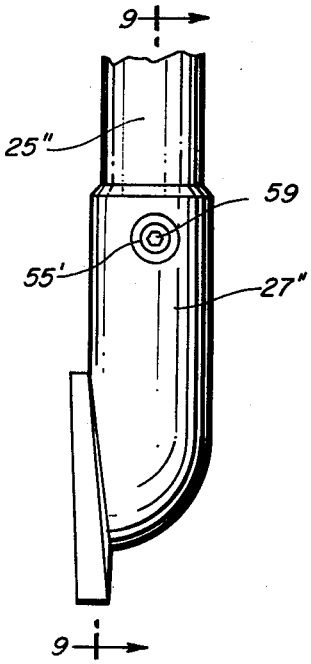
FIG. 8 is a partial side elevational view of another embodiment of a tamping tool constructed in accordance with the present invention.
Figure 9:
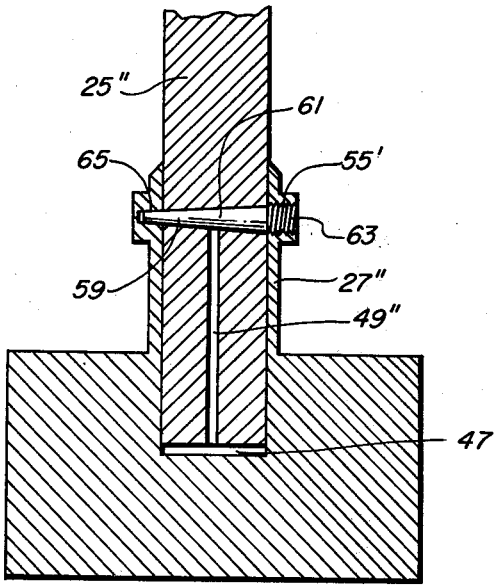
FIG. 9 is a cross-sectional view taken along line 9—9 of FIG. 8.
Figure 10:
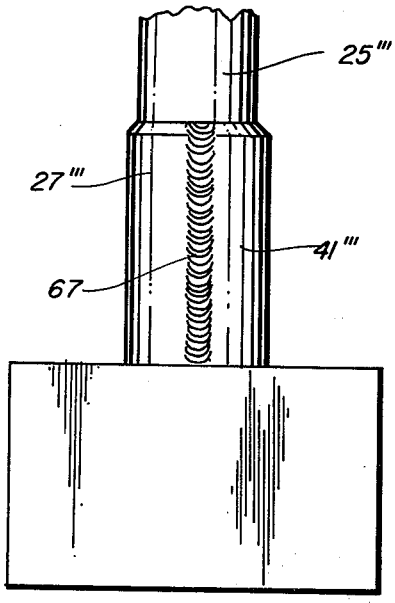
FIG. 10 is a partial front elevational view of another embodiment of a tamping tool constructed in accordance with the present invention.
Figure 11:
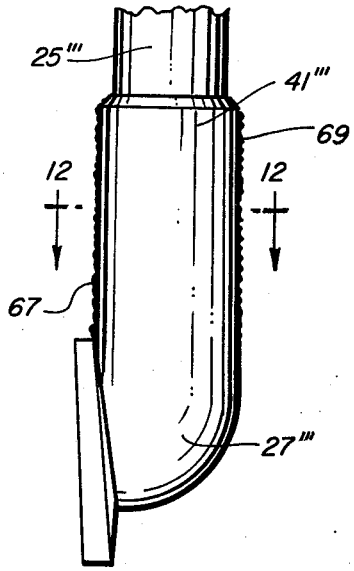
FIG. 11 is a side elevational view of the tamping tool of FIG. 10.
Figure 12:
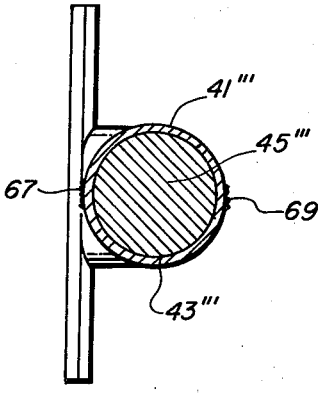
FIG. 12 is a cross-sectional view taken along line 12—12 of FIG. 11.

In the embodiment of FIGS. 8 and 9, a threaded taper pin 59 extends through a tapered opening 61 in the shank 25''. A threaded opening 55' in the foot 27'', corresponding to the threaded opening 55 in FIG. 7, engages the threaded end 63 of the taper pin 59. The other end of taper pin 59 extends into an appropriate receptacle 65 formed on the opposite side of foot 27''. In this case, the tapered opening 61 intersects the passageway 49'', so that insertion of a grease gun fitting into the threaded opening 55 in place of the taper pin 59 permits production of the repulsive force between shank 25'' and foot 27''.

To increase the binding force between the tamping foot and the shank, without the inconvenience of additional locking devices, the cross-sectional configuration of the socket and the foot may be slightly distorted. To achieve this effect, a pair of weld beads 67 and 69 may be vertically positioned along the sleeve 41'''. Beads 67 and 69 are placed diametrically opposite each other to provide a uniform distortion effect. As a welding operation causes some shrinkage of the material, the two weld beads 67 and 69 produce a slightly elliptical configuration for the socket 43'''. When shank portion 45''' is forced into socket 43''', the socket assumes the circular shape of portion 45''', but the tendency to return to the elliptical shape increases the binding force.

Figure 13:
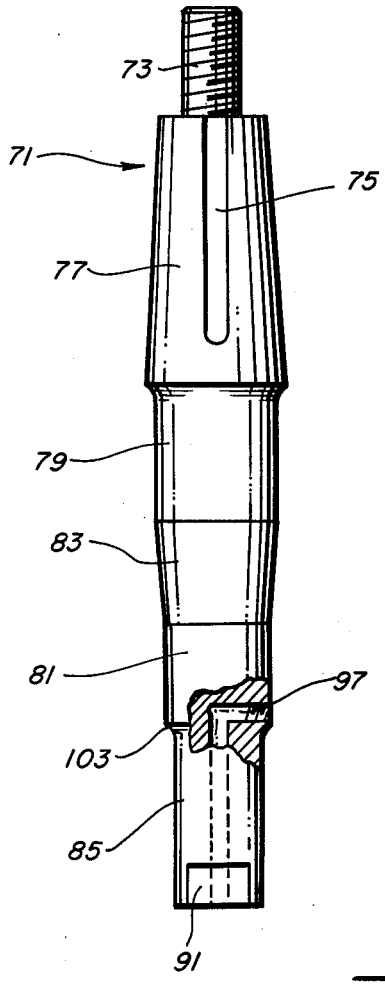
FIG. 13 is a front elevational view of a preferred embodiment of the shank of the tamping tool of the present invention.
Figure 14:
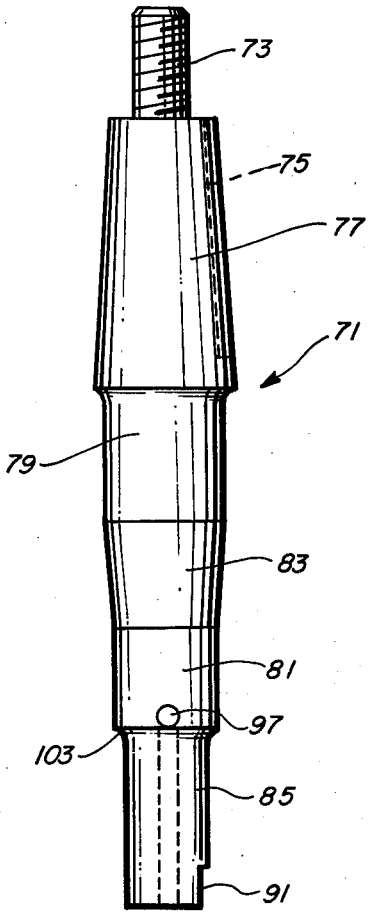
FIG. 14 is a side elevational view of the shank of the tamping tool of FIG. 13.
Figure 15:
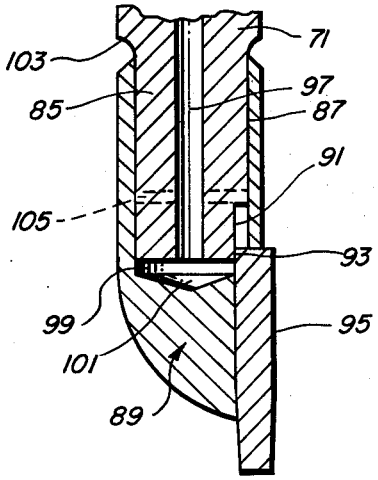
FIG. 15 is a partial cross-sectional view of the shank of the tamping tool of FIG. 13 with the tamping foot attached.

FIGS. 13–15 illustrate a particular preferred embodiment of the present invention. A shank 71 is illustrated in FIGS. 13 and 14. Shank 71 has a conventional threaded projection 73 and keyway 75 for connection to a railroad bed tamping apparatus. Keyway 75 is located in a first tapered portion 77 of shank 71. To aid in machining shank 71, two constant diameter portions 79 and 81 are provided for insertion into a suitable chuck. Portion 79 would be chucked for machining the upper end of shank 71, while portion 81 would be utilized for machining the lower end. Portions 79 and 81 are connected by an appropriately tapered portion 83.

At the lower end of shank 71, a tapered socket engaging portion 85 is provided. The angle of taper of portion 85 is such as to provide the desired fit with socket 87 of the tamping foot 89. The angle of this taper normally falls in the range of slightly greater than zero to something on the order of one inch per foot. As a matter of fact, this portion could actually be straight in some circumstances, such as where an interference fit is provided by heat shrinking. In any event, for this preferred embodiment, a taper of 3/16 inch per foot has been found desirable.

At the bottom of portion 85, a flat surface 91 has been formed on a portion of the circumference. This flat surface 91 mates with a corresponding flat surface 93 formed by the projection of the tamping plate 95 upward into socket 87. The mating of these two flat surfaces aids in preventing relative rotation between shank 71 and tamping foot 89.

A passageway 97 is provided for conveying fluid into an expandable chamber 99 located between the end of shank 85 and the bottom of socket 87. As previously described, the tapers of portion 85 of shank 81 and socket 87 of foot 89 are determined to prevent any contact between the end of shank 71 and the bottom of socket 87. In this preferred embodiment, further insurance that the expandable chamber 99 always exists is provided by the conical extension 101, which would still exist even if the end of shank 71 were driven to the regular bottom of socket 87. Still further protection is provided by the shoulder 103 at the top of the portion 85 of shank 71. Generally, the fit between shank portion 85 and socket 87 is sufficient to provide the fluid-tight fit required for generating the repulsive force when it is desired to remove foot 89. However, in some cases it may be found necessary to insure the fluid-tight junction, which may be achieved by the insertion of an O-ring 105, as shown.

It should be understood that various modifications, changes and variations may be made in the arrangement, operation and details of construction of the elements disclosed herein without departing from the spirit and scope of this invention.

I claim:

1. A tamping tool for use with railroad bed tamping apparatus comprising:

a shank, the upper end of said shank being attachable to the tamping apparatus;

a removable tamping foot to be affixed to said shank;

a socket formed in said tamping foot;

a socket engaging portion formed at the lower end of said shank, forcible insertion of said socket engaging portion into said socket producing a force fit to secure said tamping foot to said shank with a fluid-tight joint;

an expandable chamber formed between the lower end of said shank and the bottom of said socket;

a passageway extending from said expandable chamber through said shank;

a fitting located on the tamping tool above said expandable chamber and connecting with said passageway, said fitting being selectively attached to pumping means to drive a fluid through said passageway to said expandable chamber to generate a pressure sufficiently great to break said fluid-tight joint between said shank and said tamping foot and permit removal of said tamping foot by hand; and locking means replacing said fitting to further secure said tamping foot to said shank during tamping action, said fitting being substituted for said locking means when it is desired to remove said tamping foot.

2. A tamping tool as claimed in claim 1 wherein said pumping means comprises hydraulic pumping means to drive a liquid through said passageway to said expandable chamber.

3. A tamping tool as claimed in claim 2 wherein said hydraulic pumping means comprises a hand-operated grease gun and the liquid driven through said passageway to said expandable chamber is grease.

4. A tamping tool as claimed in claim 1 wherein said locking means comprises:

a slotted keyway formed in said shank, said keyway extending into said passageway; and a set screw threaded into said tamping foot to engage said keyway.

5. A tamping tool as claimed in claim 1 wherein said locking means comprises:

a tapered opening passing through said shank transversely to the axis thereof, said tapered opening intersecting said passageway; and a threaded taper pin, one end of said pin being threaded into said tamping foot and the other end extending through said tapered opening into a receptacle formed in said tamping foot opposite the threaded connection.

6. A tamping tool as claimed in claim 1 and further comprising a weld bead extending down opposite external surfaces of said tamping foot to increase the binding force between said foot and said shank.

7. A tamping tool as claimed in claim 1 and further comprising:

a first flat surface formed along one section of said socket in said tamping foot; and a second flat surface formed along one section of said tapered portion of said shank, engagement of said flat surfaces opposing rotation of said tamping foot with respect to said shank.

8. A tamping tool as claimed in claim 1 and further comprising a conical extension of said socket to insure the existence of said expandable chamber regardless of the extent to which said shank is driven into said socket.

9. A tamping tool for use with railroad bed tamping apparatus comprising:

a shank, the upper end of said shank being attachable to the tamping apparatus;

a removable tamping foot to be affixed to said shank;

a tapered socket formed in said tamping foot;

a first flat surface formed along one section of said socket in said tamping foot;

a tapered socket engaging portion formed at the lower end of said shank, forcible insertion of said socket engaging portion into said socket producing a force fit to secure said tamping foot to said shank with a grease-tight joint;

a second flat surface formed along one section of said tapered portion of said shank, engagement of said first and second flat surfaces opposing rotation of said tamping foot with respect to said shank;

an expandable chamber formed between the lower end of said shank and the bottom of said socket, the angles of the tapers of said socket and said socket engaging portion insuring that said grease-tight joint is established and that the end of said shank does not come into contact with the bottom of said socket;

a passageway extending from said expandable chamber through said shank;

a grease gun fitting located on the tamping tool above said expandable chamber and connecting with said passageway, said grease gun fitting being selectively attached to a grease gun for driving grease through said passageway to said expandable chamber to generate a repulsive force between said shank and said foot to permit removal of said tamping foot from said shank by hand; and locking means replacing said fitting to further secure said tamping foot to said shank during tamping action, said fitting being substituted for said locking means when it is desired to remove said tamping foot.

10. A tamping tool as claimed in claim 9 wherein said locking means comprises:

a slotted keyway formed in said shank, said keyway extending into said passageway; and a set screw threaded in said tamping foot to engage said keyway.

11. A tamping tool as claimed in claim 9 wherein said locking means comprises:

a tapered opening passing through said shank transversely to the axis thereof, said tapered opening intersecting said passageway; and a threaded taper pin, one end of said pin being threaded into said tamping foot and the other end extending through said tapered opening into a receptacle formed in said tamping foot opposite the threaded connection.

* * * * *